United States Patent [19]

Goto et al.

[11] Patent Number: 4,566,863

[45] Date of Patent: Jan. 28, 1986

[54] ROTARY COMPRESSOR OPERABLE UNDER A PARTIAL DELIVERY CAPACITY

[75] Inventors: Kunifumi Goto, Nagoya; Manabu Sugiura, Takahama; Shinichi Suzuki, Okazaki, all of Japan

[73] Assignee: Kabushiki Kaisha Toyoda Jidoshokki Seiaskusho, Kariya, Japan

[21] Appl. No.: 651,612

[22] Filed: Sep. 17, 1984

[30] Foreign Application Priority Data

Sep. 16, 1983 [JP] Japan ..... 58-171969

[51] Int. Cl.[4] ..... F04B 49/02; F04B 49/08

[52] U.S. Cl. ..... 417/295; 417/299; 417/300; 417/310

[58] Field of Search ..... 417/299, 295, 300, 310

[56] References Cited

U.S. PATENT DOCUMENTS

| | | | |
|---|---|---|---|
| 3,367,562 | 2/1968 | Persson | 417/295 |
| 3,448,916 | 6/1969 | Fraser | 417/295 |

FOREIGN PATENT DOCUMENTS

| | | | |
|---|---|---|---|
| 255114 | 12/1912 | Fed. Rep. of Germany | 417/310 |
| 428020 | 4/1926 | Fed. Rep. of Germany | 417/295 |
| 57-159979 | 10/1982 | Japan | 417/299 |

*Primary Examiner*—Richard E. Gluck

*Attorney, Agent, or Firm*—Brooks Haidt Haffner & Delahunty

[57] ABSTRACT

A rotary compressor for compressing a refrigerant gas has a by-pass port and a control valve means. The by-pass port communicates at one end with a suction chamber containing the gas to be compressed, and at the other end with a compression chamber wherein compression of the refrigerant gas is in progress. The control valve means includes a valve spool accommodated in a chamber formed in a front side plate of the compressor and movable between its full-load position, where a gas suction port is opened to the compression chamber while the by-pass port is closed, and its partial-load position where the former is at least partially closed while the latter is opened. The valve spool is normally biased to its partial-load position. During operation of the compressor, the valve spool is placed under the influence of a first pressure of the gas acting to urge the same towards its said full-load position, and to a second pressure of the gas to urge the same towards its said partial-load position. The spool is shifted automatically to its partial-load position when the difference between these first and second pressures is decreased with a drop of cooling load. The compressor of the invention further comprises a flow control means for regulating the flow of the gas into its compression chambers in the event of a rapid increase of compressor speed.

19 Claims, 7 Drawing Figures

ROTARY COMPRESSOR OPERABLE UNDER A PARTIAL DELIVERY CAPACITY

FIELD OF THE INVENTION

The present invention relates to rotary compressors for refrigeration or air cooling systems, and more particularly, to the means for regulating the operation of such compressors under partial as well as full load operations, and at various driven speeds. Although the invention will be described in connection with compressors as may be used in automobile air conditioning systems, it will be apparent that the invention is useful in compressors for other purposes.

BACKGROUND OF THE INVENTION

A compressor employed in an automotive cooling system for cooling the driver's compartment of a vehicle is required to operate under varying speed conditions and with a large delivery capacity while the system is working to decrease the compartment temperature. When a comfortable temperature has been reached in the compartment and, therefore, the system only has to maintain that level of temperature, the compressor is not required to operate under such a large delivery capacity as before, and it is desirable that the compressor be switched to a partial-load operation. Moreover, the compressor must be capable of such partial-load operation under the same varying speeds of auto engine operation.

Accordingly, an object of the present invention is to provide a rotary compressor which can be operated, when required, under a partial load by reducing its delivery capacity substantially in the entire range of operating speeds.

SUMMARY OF THE INVENTION

The present inventors partially solved the above problem by providing a rotary compressor having a by-pass passage which allows the suction chamber to communicate with a compression chamber of the compressor wherein compression of a refrigerant gas is taking place, and a movable valve spool adapted to open and close the by-pass passage under the balancing influence of a first pressure acting on one end of the valve spool and exerted both by a spring and by the suction gas in a direction tending to open the by-pass passage, and a second pressure acting on the other end and exerted by the discharge gas in opposite direction tending to close said passage. When the difference in pressure between the suction and discharge gas pressures is decreased pursuant to a drop in cooling load on the refrigeration system, the spool is moved by the resilient pressure of the spring in the direction to open the by-pass passage so as to allow part of the refrigerant gas in the compression chamber to escape through the by-pass passage into the suction chamber, thus enabling the compressor to operate with a reduced delivery capacity or under a partial load.

It has been revealed, however, that though the provision of such a by-pass passage proves to be effective while the compressor is running at low speeds, it does not completely provide the intended effect to reduce the delivery capacity of the compressor (or to place the compressor under a partial-load operation) in a high-speed range. This is because the refrigerant gas tends to be compressed in the compression chamber before a sufficient portion of the gas can escape through the by-pass passage into the suction chamber.

Thus, in its preferred embodiment there is provided a compressor comprising a housing, a drive shaft rotatably supported in the housing and having a rotor rotatable with the drive shaft. The off-centered mounting of the rotor and its radially biased vanes provides a plurality of compression chambers whose volumes are variable progressively in an alternate increasing and decreasing manner commensurate with the rotation of the rotor. A suction chamber of the compressor has an inlet port communicating with one of those rotating compression chambers which is receiving refrigerant gas via a suction passage. A by-pass passage is provided between one of those rotating compression chambers wherein compression of the gas is taking place and the suction chamber, for by-passing part of the gas from that compression chamber back into the suction chamber. In addition, the compressor incorporates a control valve means comprising a chamber, a valve member preferably in the form of a valve spool which is received in the valve chamber and is movable between a first position thereof in which the suction passage is opened while the by-pass passage is closed, and a second position thereof in which the suction passage is at least partially closed while the by-pass passage is opened. A spring biases the valve member towards the second position. Furthermore, at one end of the valve chamber a high-pressure cavity is formed for receiving gas whose pressure will act on the valve member in a direction to move it towards its said first position. At the other end of the valve chamber a low-pressure cavity is formed for receiving gas whose pressure will act on the valve member to move it towards its said second position. Thus, the valve member is shifted automatically to its second position when the pressure difference between these high-pressure and low-pressure cavities is decreased with a decrease of cooling load on the refrigeration system of which the compressor is a part.

With the valve member thus shifted towards its second position wherein the suction passage is at least partially closed while the by-pass passage is opened, part of the refrigerant gas is vented or released from the compression chamber through the by-pass port and, simultaneously, the charge of refrigerant gas flowing through the suction passage into the compression chamber is regulated. Since these two operating actions of the by-pass passage and the suction passage complement each other and under either action the compressor can work properly, the compressor can be placed under the desired partial-load operation regardless of operating conditions, and within a fairly wide range of operating speeds. Furthermore, opening or closing of the by-pass passage and reducing of the suction passage's effective open area can be effected by the movement of a single member, i.e. the valve spool, and the compressor construction is relatively uncomplicated.

As is apparent from the foregoing, a compressor of the above construction is capable of performing its gas compression function properly over a wide range of operating speeds by its ability to automatically adjust to either its full-load or partial-load position in accordance with varying heat load. A problem is presented, however, when such a compressor is used in an automotive air cooling system and is therefore driven by an automotive engine. That is, when the speed of the engine which drives the gas compressor is built up rapidly by accelerating the engine, the compressor will also increase its speed rapidly and, therefore, the valve spool, which is designed to provide a proper control during a normal driving condition, tends to move towards the first position thereof, which corresponds to the full-load operation of the compressor, when such is not desirable. This is because there is a tendency for the spool to move towards the first position with a remarkable increase of speed because the low-pressure cavity of the spool receives the full suction pressure (or the gas pressure of the suction chamber or of the compression chamber at its earlier stage of the gas compression process) and the high-pressure chamber is subjected to the full discharge pressure (or the gas pressure of the discharge chamber or of the compression chamber wherein compression of the gas is in progress). Consequently, the load applied to the engine by the compressor will be increased unfavorably, which affects the accelerating performance of the engine as a matter of course.

For improvement in the accelerating operation of the engine by relieving the excessive load thereon, it is desirable that the compressor should be placed in a state of partial-load operation. This is true of any compressor which is driven by any drive system provided for any other purposes.

For this purpose, there is provided a rotary compressor according to the invention which further comprises, in addition to the aforementioned control valve means, a flow control means which is adapted to be operated in response to the varying pressure of the refrigerant gas flowing in the suction chamber for regulating the flow of the gas to be drawn into the compression chamber which is receiving the gas from the suction chamber. This flow control means includes a valve having a pressure-receiving portion which is so disposed as to be subjected to the influence of the dynamic pressure of the gas flowing in the suction chamber, the pressure-receiving portion being provided such that when it receives the dynamic pressure the flow control valve is operated in a way to decrease the charge of the gas being introduced into the compression chamber, and means for urging the flow control valve in the opposite direction to increase the charge.

In such a structure of the compressor, while the heat load on the refrigeration system in which the compressor is connected is low and therefore the pressure difference between the high- and low-pressure chambers is low, the spool is placed at its partial-load position in the manner already described. On the other hand, when the rotor speed is increased rapidly, the flow control valve is operated by the increased velocity of the gas flowing in the suction chamber in a way to reduce gas flow into the compression chamber which is receiving it, so that the compressor is placed in its partial-load position at such times. Thus, the compressor can be brought to a state of partial-load operation not only while the heat load on the refrigeration circuit is small, but also when the compressor speed is increased rapidly responsive to acceleration of the engine which drives the compressor. The result is that the load imposed on the engine from the compressor during engine acceleration can be advantageously reduced.

DETAILED DESCRIPTION OF PREFERRED EMBODIMENTS

The above and other objects, features and advantages of the present invention will become more readily apparent from the following detailed description of its preferred embodiments, when taken in conjunction with the accompanying drawings, in which:

FIGS. 6 and 7 are views respectively similar to FIGS. 1 and 3 to illustrate modifications of the invention.

A rotary gas compressor of the vane type according to the present invention, which is applicable to an automotive refrigeration system, will now be described more in detail by way of preferred embodiments thereof with reference to the accompanying drawings.

Figure 1:
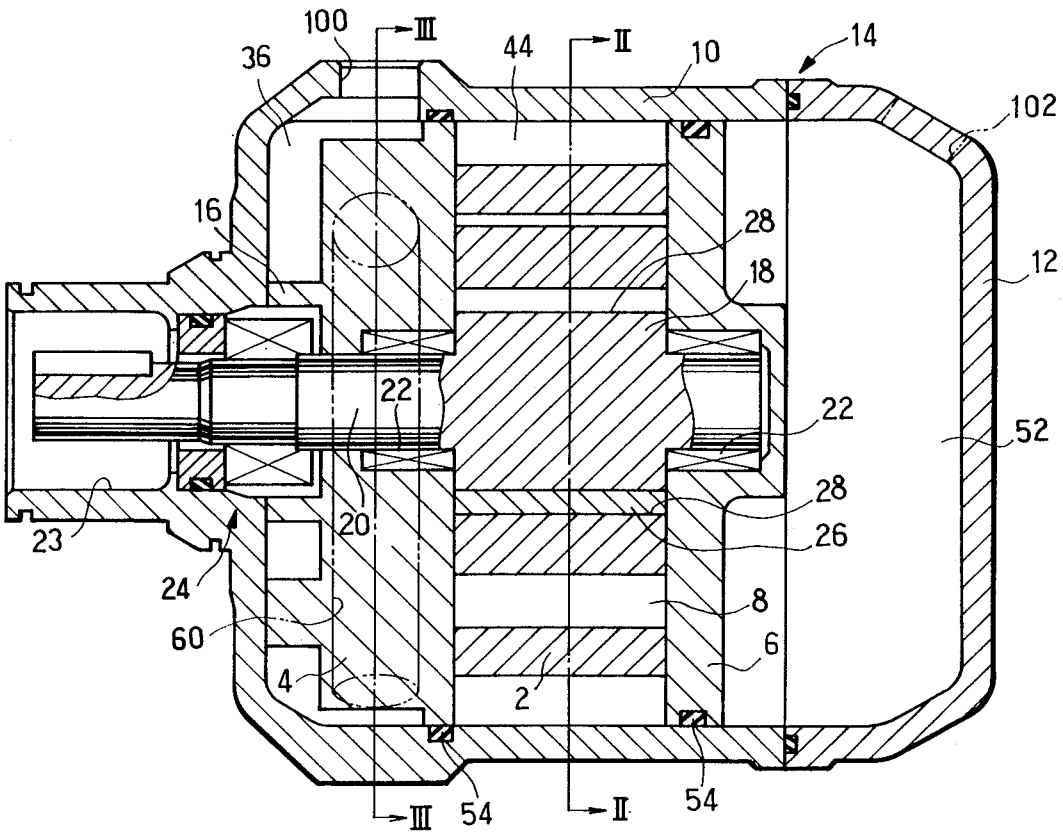
FIG. 1 is a front elevation in cross-section of a preferred embodiment of a rotary compressor of the vane type according to the present invention.

Referring to FIG. 1, there is provided a cylinder block 2 having a cylindrical bore with its open ends closed by a front side plate 4 and a rear side plate 6, respectively, whereby the inner peripheral surface of the cylinder block cooperates with the the front and rear side plates to define a rotor chamber 8. The cylinder block 2 and the front and rear side plates 4, 6 are enclosed by a front housing 10 and a rear housing 12, and all these are fastened together securely by means of fasteners such as bolts to form an integral housing assembly for the compressor, which is designated generally by reference numeral 14. The front side plate 4 is formed on its front face, or a face on the left-hand side thereof as viewed in FIG. 1, with a projecting supporting wall 16 so as to receive the force due to the fastening by bolts and including, as illustrated specifically in FIG. 3, a cylindrical-shaped center portion and a plurality of portions extending radially therefrom.

Returning to FIGS. 1 and 2, a rotor 18 having a circular section is disposed eccentrically within the rotor housing 8 in such a way that the rotor is kept barely in sliding contact with the inner peripheral surface of the housing along a line of contact C. The rotor 18 has drive or supporting shafts 20 projecting from the centers of opposite ends thereof, which are journalled by the front and rear side plates 4, 6 by way of bearings 22, 22, respectively. The front end of the drive shaft 20 supported by the front side plate 4 is extended into a bore 23 which is formed at the center of the front housing 10. Air-tightness between the front housing 10 and the shaft 20 is ensured by a shaft sealing device 24.

Figure 2:
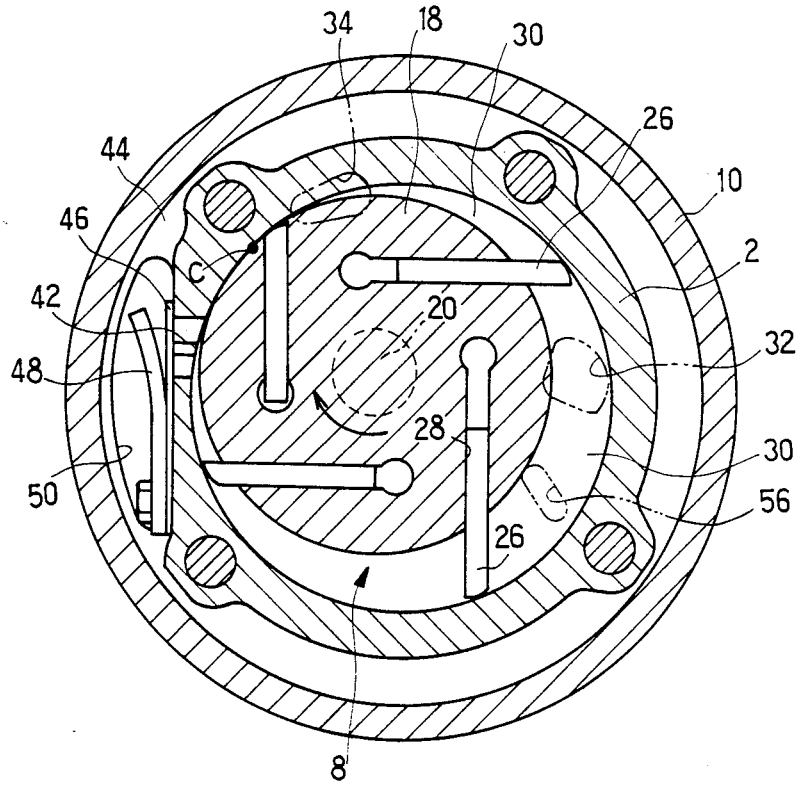
FIG. 2 is a cross-sectional view taken along the line II—II of FIG. 1.

Referring then to FIG. 2, the rotor 18 includes four blades or vanes 26 which are received in their corresponding vane slots 28 in such a way that the vanes can slide in their slots so that their outer ends are projected out of and retracted into the slots as the rotor 18 is rotated, and are urged by any suitable means, such as springs or pressure by the refrigerant gas, in direction causing the outer end of each vane to be pressed against the inner peripheral surface of the rotor chamber 8. Accordingly, a plurality of air-tight spaces or compression chambers 30 are formed, each of which is enclosed and defined by any two adjacent vanes 26, the peripheral surface of the rotor 18, the inner peripheral surface of the cylinder 2, and the inner wall surfaces of the front and rear side plates 4, 6. The spatial volume of each compression chamber 30 is caused to be progressively varied, or increased and decreased alternately, as the rotor 18 is rotated on its shafts 20 in the direction of the arrow shown in FIG. 2.

Figure 3:
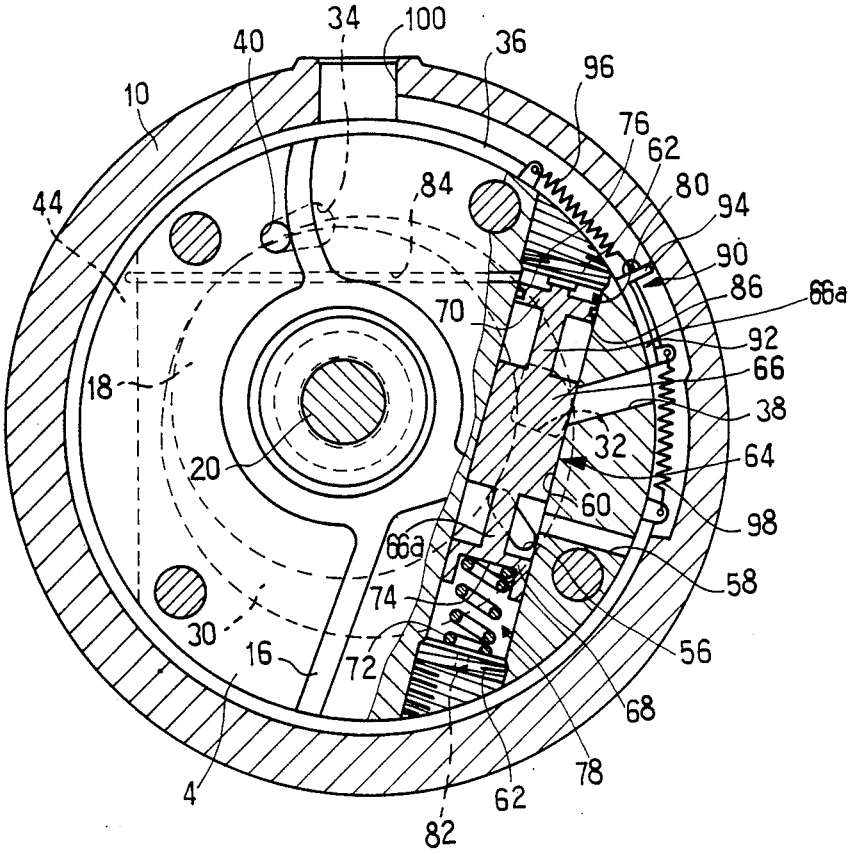
FIG. 3 is also a cross-sectional view taken along the line III—III of FIG. 1.

A main suction or inlet port 32 and an auxiliary inlet port 34 are formed on the rear face of the front side plate 4 at such positions that each such inlet port communicates with a compression chamber 30 which is then in the process of increasing its volume for drawing thereinto a charge of refrigerant gas. The auxiliary inlet port 34 is located adjacent to the sealing point provided by the line of contact C, between the cylinder 2 and the rotor 18, while the main inlet port 32 is opened at a position spaced downstream from the auxiliary suction port 34 with respect to the direction of rotation of the rotor 18 and has an opening area greater than that of the auxiliary suction port 34. The main inlet port 32 communicates with a suction chamber 36 defined, as shown in FIG. 1, by and between the front side plate 4 and the front housing 10 through a suction passage 38 opened to the outer periphery of the front side plate 4 as shown in FIG. 3. On the other hand, the auxiliary inlet port 34 is in communication with the suction chamber 36 via a suction passage 40 which is opened on the front face of the front side plate 4.

The gas drawn through these main and auxiliary inlet ports 32, 34 into the moving compression chamber 30 and then compressed therein with progressive decrease of its volume as the compressor rotates, is subsequently forced out of the chamber through one or more outlet ports 42 formed through the wall of the cylinder block 2, to discharge into a discharge chamber 44 defined by and between the cylinder block 2 and the front housing 10. The flow of the refrigerant gas through the outlet ports 42 is controlled by a flexible reed valve 46 which covers the outlet ports 42 on the side of the discharge chamber 44, and whose degree of opening is regulated by a retainer 48. The discharge chamber 44 communicates through an opening 50, bored through the rear side plate 6, with an oil separating chamber 52 having a filter (not shown) by which lubricating oil contained in a mist form is separated from the discharged refrigerant gas. O-rings 54, 54 are provided to seal the discharge chamber 44 from the oil separating chamber 52 and the suction chamber 36, respectively.

As shown in FIG. 2, a release or by-pass port 56 is provided on the rear face of the front side plate 4, in communication with a compression chamber 30 wherein compression of the refrigerant gas charge is in progress. As is apparent from FIG. 2, this by-pass port 56 is located at a position adjacent to the main suction port 32 and spaced therefrom toward the discharge ports 42. The by-pass port 56 is in the form of an elongated opening having a width whose dimension is smaller than the thickness of the vanes 26 and extending at such an inclination that said elongated opening may be substantially closed by a side face of the vane when the latter moves past the former so that no gas leakage may take place from a compression chamber 30 of a higher pressure to another adjacent compression chamber of a lower pressure through this by-pass port 56. Furthermore, this by-pass port 56 communicates with the suction chamber 36 through a release or by-pass passage 58 which is opened on its opposite end through the periphery of the front side plate 4, as shown in FIG. 3.

In the front side plate 4 is formed a cylindrical spool receiving chamber 60 which extends in such a way that it connects the by-pass port 56 and the main inlet port 32. As indicated by the phantom lines in FIG. 1, this spool chamber 60 is provided in the form of a cylindrical space whose diameter is smaller than the thickness of the front side plate 4 and which extends parallel to the side faces thereof. As seen from FIG. 3, the spool chamber 60 may be formed by boring a through hole extending in the front side plate 4 in parallel relation to the side faces thereof and by closing said through hole by closing members 62, 62 which are screwed into the ends of the hole, respectively. The main inlet port 32 of the suction passage 38 and the by-pass port 56 of the by-pass passage 58 are opened into said spool chamber 60. In other words, the main suction inlet port 32 and the by-pass port 56 communicate with the suction chamber 36, respectively, through the cylindrical space of the spool chamber 60.

In the cylindrical space of the spool chamber 60 is slidably fitted a valve spool 64. The valve spool 64 includes at its center a valve portion 66 which slides airtightly in contact with the inner peripheral surface of the spool chamber 60 and at its ends pressure-receiving portions 68, 70 which are formed, respectively, at the outer ends of small-diametered rod portions **66*a*, 66*a* projecting from the center of the opposite ends of the valve portion 66. The pressure-receiving portions 68, 70 have the same diameter as the valve portion 66. The spool 64 is movable over a stroke between a full-load position where the main inlet port 32 is opened while the by-pass port 56 is closed and a partial-load position, shown in FIG. 3, where the main suction inlet port 32 is at least partially closed while the by-pass port 56 is opened. The spool 64 is urged towards its partial-load position under the influence of a resilient member, such as a spring 72. The partial-load position of the spool 64 is regulated by the pressure-receiving portion 70 of the spool 64 then being in contact with the closing member 62. The pressure-receiving portions 68, 70 have first and second pressure-receiving faces 74 and 76, respectively, at the outer faces thereof, wherein the first pressure-receiving face 74 has a recess which serves as a spring seat receiving therein one end of the spring 72 whose opposite end is supportedly received by the closing member 62**.

The first pressure-receiving face 74 cooperates with the closing member 62 to define a space 78 which is referred to as the low-pressure cavity, while the second pressure-sensitive face 76 and the other closing member 62, on the opposite side of the spool 64, form therebetween another space 80 which is referred to as the high-pressure cavity. The low-pressure cavity 78 communicates, in the illustrated embodiment, with the suction chamber 36 via a passage 82 which is bored through the closing member 62. The refrigerant gas under suction pressure drawn through the passage 82 into the low-pressure cavity 78 acts on the first pressure-receiving face 74 in direction pushing the valve spool 64 towards its partial-load position. On the other hand, the high-pressure cavity 80 is in communication with the discharge chamber 44 by way of a passage 84 formed in the front side plate 4. The refrigerant gas under discharge pressure introduced through the passage 84 into the high-pressure cavity 80 acts on the second pressure-sensitive face 76, thereby urging the spool 64 towards its full-load position. Therefore, the valve spool 64 is held in its full-load position while the sum of the pressures exerted by the spring 72 and the suction gas in the low-pressure cavity 78 is smaller than the pressure exerted by the discharge gas in the high-pressure cavity 80 acting to urge the spool in the opposite direction. When the former sum of pressures exceeds the latter pressure, on the other hand, the spool 64 is brought toward its partial-load position which is shown in FIG. 3.

The pressure-receiving portion 70 of the spool chamber 64 has an O-ring 86 fitted around the periphery thereof not only for providing a sealing effect, but also for producing an appropriate frictional force to inhibit the sliding of the portion 70 along the inner surface of the spool chamber 60. Therefore, the valve spool 64 will not actually start to move in either direction until the difference in the above pressures acting in opposing directions becomes great enough to first overcome the frictional force created by this O-ring 86. The spool's irregular vibrating motion due to variations in gas pressures is thus forestalled, with the result that stability in the sliding movement of the spool 64 is ensured. In addition, the spring 72 is so arranged that the variation in its acting pressure upon compression thereof may be such as to make it possible for the the spool 64 to move gradually in response to the differences in pressures being applied to the opposite ends of the spool 64. This can be accomplished by preloading the spring 72 at a comparatively small value.

Adjacent to the opening of the suction passage 38 into the suction chamber 36 is a slider 90 which is provided as a flow control valve means for adjusting the open area of the suction passage 38. The slider 90, which is slidably mounted along the periphery of the front side plate 4, includes a valve portion 92 which is provided in sliding contact with the periphery of the front side plate 4 for adjusting the effective area of of the suction passage 38. This valve portion 92 is formed with a radius of curvature corresponding to that of the circumferential periphery of the front side plate 4 and has a size large enough to close said opening.

The refrigerant gas introduced into the suction chamber 36 flows towards the opening of the suction passage 38, whereupon it is drawn through the main inlet port 32 into the compression chamber 30. The valve portion 92 of the slider 90 has a pressure-receiving portion 94 projecting in a radially outward direction with respect to the front side plate 4 at the end thereof which is on the upstream side with respect to the direction of the gas flow in the chamber 36. This pressure-receiving portion 94 receives the dynamic pressure of the refrigerant gas flowing in the suction chamber 36 toward the opening of the suction passage 38 thereby being subjected to an urging force that acts to reduce the open area of the opening 38. Though offering resistance against the gas flow, the portion 94 is so designed as to allow a flow of gas therepast to the suction passage 38.

As shown in FIG. 3, the slider 90 has coil springs 96, 98 whose ends on one side are attached to the opposite ends of the slider, the other ends of which are retained on the periphery of the front side plate 4. Though these springs 96, 98 act to pull the slider 90 resiliently in opposite directions along the periphery of the front side plate 4, the slider is normally urged in a direction which causes the open area of the opening of the suction passage 38 to be increased under the influence of the difference in resilient pressure between these springs 96, 98. In the specific embodiment illustrated herein, the slider 90 is normally maintained in a position where the opening of the suction passage 38 is wide open, and the urging forces of the springs 96, 98 are so selected that the slider 90 will not be moved in a direction to decrease the wide-open area of the passage 38 by the gas flow produced under the normal operating condition of the compressor (e.g., at about 2,000 rpm of compressor running speed).

Incidentally, these two springs 96, 98 can serve to guide the movement of the slider 90 in opening and closing directions, but any suitable guide may be formed on the periphery of the front side plate 4 for the same purpose.

The compressor thus constructed is connected at the suction and discharge ports 100, 102 thereof to the inlet and outlet conduits (not shown) of the automotive cooling system, respectively, and its drive shaft 20 is operatively connected to an engine of the vehicle by way of any suitable power transmission system which includes an electromagnetic clutch.

The operation of the compressor constructed as disclosed hereinabove will be described below.

While the compressor is kept at rest for a long period of time, all the spaces within the compressor are placed under a substantially equal pressure. In the meantime, the spool 64 is held at its partial-load position as shown in FIG. 3 under the influence of the biasing pressure of the spring 72, whereby the main suction or inlet port 32 is closed while the by-pass port 56 is opened. In such a state of the compressor, the slider 90 is positioned such that its associated opening of the suction passage 38 is wide open.

Upon engagement of the abovesaid electromagnetic clutch (not shown) for connection of a drive source such as an automotive engine to the drive shaft 20, thereby starting the rotor 18 to rotate together with the vanes 26, refrigerant gas is drawn through the suction port 100 into the suction chamber 36, and is subsequently introduced only through the auxiliary inlet port 34 into a compression chamber 30 which is then in its suction phase. As the compression chamber 30 changes its phase from suction to compression, part of the gas in that compression chamber is vented through the by-pass port 56 and its by-pass passage 58 to return to the suction chamber 36, while the remaining gas is compressed only after the vane 26 defining the trailing wall of the compression chamber 30 has completely closed the by-pass port 56. In this way, just after a start-up of the compressor, it is operated with a partial load capacity. Consequently, the compressor can be started smoothly with less starting torque so that the variation in load to be imposed on the engine can be advantageously lessened.

As the gas pressure in the discharge chamber 44 is built up sufficiently after the above-described partial-load operation of the compressor for a short period of time to such an extent that the difference between the relatively high pressure of discharged refrigerant gas acting on the second pressure-receiving face 76 of the spool 64 and the relatively low pressure of suction gas acting on the first pressure-receiving face 74 thereof in opposite direction substantially exceeds the biasing force of the spring 74, the valve spool 64 is caused to move to its full-load position, where the main inlet port 32 is opened while the by-pass port 56 is closed, accordingly. Consequently, the refrigerant gas in the suction chamber 36 is then introduced into the compression chamber 30 not only through the auxiliary inlet port 34, but also through the main inlet port 32. Because the by-pass port 56 is kept closed by the spool 64 then positioned in its full-load position, the gas introduced and confined in the compression chamber 30 will not escape through the by-pass port 58, and the compressor is therefore placed under its 100% full-load operation.

As the cooling load (or the heat load on the refrigeration circuit) is reduced with a gradual drop of temperature in the vehicle's compartment close to a comfort level during the above full-load operation of the compressor for any period of time, the pressure of the suction gas is decreased and, accordingly, the difference in pressure between the suction gas and the discharge gas is reduced for the reason that is stated below.

Generally, the pressure $P_2$ of a gas compressed into a volume $V_2$ from a volume $V_1$ then with a pressure $P_1$ may be formulated as follows:

$$P_2 = P_1(V_1/V_2)^n$$

Therefore, the pressure difference $\Delta P$ may be expressed as follows:

$$\begin{aligned}\Delta P &= P_2 - P_1 \\ &= P_1\{(V_1/V_2)^n - 1\}\end{aligned}$$

As is apparent from the above, the smaller the pressure $P_1$ is before compression, the smaller is the pressure difference $\Delta P$. Therefore, if the pressure of the suction gas is decreased with a drop of the cooling load, the difference between the gas pressures acting on the first and second pressure-receiving faces 74, 76, respectively, is also decreased. As this difference in pressure becomes less than the biasing force exerted by the spring 72, the spool 64 is moved to its partial-load position thereby to close the main inlet port 32 and open the by-pass port 56. This movement of the valve spool 64 takes place gradually in response to a decrease of the difference in pressures of the refrigerant gas acting in opposite directions. In addition, the provision of the O-ring 86 on the periphery of the pressure-receiving portion 70 can provide a hysteresis effect, by which the spool 64 can be moved without any harmful vibrating motion even under the influence of a delicate, irregular variation in the pressure difference.

With the spool 64 thus moved to its partial-load position at which the the main inlet port 32 is closed and the by-pass port 56 opened, the compressor is placed again in its partial-load operation, whereby a comfort temperature level is maintained under a reduced delivery capacity of the compressor. Since this partial-load operation is made possible by two functions, i.e., regulating the flow of refrigerant gas into the compression chambers 30 with the main inlet port 32 closed or its open area reduced while, simultaneously, releasing part of the gas through the by-pass port 56 back into the suction chamber 36, the partial-load operation of the compressor can be accoplished successfully through the complementary effect of these two functions even in the event that either of the functions is not able to contribute sufficiently to the reduction of the compressor's delivery capacity for any reason, e.g, due to inertia of the flowing gas.

When the compressor is running at a normal speed (e.g. 2,000 rpm), the velocity of the refrigerant gas flowing in the suction chamber 36 is so low that that the gas flow does not produce a dynamic pressure which is strong enough to move the slider 90, by acting on the pressure-receiving portion 94 thereof, in a direction to close the opening of the suction passage 38 on the side of the suction chamber 36, so that the opening 38 is kept wide open while the compressor is running at such normal speed.

When the compressor speed is increased to a level, e.g., exceeding 3,000 rpm, by accelerating the engine, the refrigerant gas flowing in the suction chamber 36 increases its velocity and, therefore, its dynamic pressure acting on the pressure-sensitive portion 94 of the slider 90. As the pressure is built up to the extent where the sum of the dynamic pressure of the gas and the bias pressure of the spring 98 overcomes the bias pressure of the spring 96, the slider 90 moves in a direction to reduce the open area of the opening of the suction passage 38 on the side of the suction chamber 36. The slider 90 comes to rest in a position where the opening 38 is either partially or fully closed, depending upon the velocity of the gas then flowing in the suction chamber 36. By so moving the slider 90, the flow of gas into the compression chamber 30 through the main inlet port 32 is reduced or, when the opening is fully closed by the slider 90, the gas is drawn only through the auxiliary inlet port 34. Thus, the compressor can be operated under a partial load even if the spool 64 is then placed at its full-load position under a relatively high cooling load.

On the other hand, in the event of a remarkable increase in compressor speed due to the acceleration of the engine while the spool 64 is located at its partial-load position, the spool 64 tends to move to its full-load position temporarily. Even if the spool 64 is thus shifted, however, the increased velocity of the gas flowing in the suction chamber 36 caused by the increase in compressor speed forces the slider 90 to move in a direction to close the opening of the suction passage 38, thereby to regulate the amount of gas admitted into the compression chambers 30, so that the partial-load operation of the compressor is resumed by nullifying the effect of the spool being shifted to the full-load position. Thus, a temporary increase of load on the engine can be avoided successfully.

That is, when the speed of the engine that drives the compressor is built up at a rapid rate by accelerating operation, the compressor places itself automatically under a partial-load operation, regardless of the position in which the valve spool 64 is then located (partial-load or full-load), by regulating the flow of refrigerant gas admitted through the suction passage 38. As a result, an increase of the load to be applied to the engine during acceleration can be avoided and, therefore, the accelerating performance of the vehicle is improved greatly. The combination of the slider 90, which is operated in response to the change in velocity of the refrigerant gas in the suction chamber 36, and the valve spool 64 which is operated in accordance with the change in cooling load, can contribute greatly to the improvement of driving feel under any operating conditions of the compressor.

While the present invention has been described and illustrated with reference to a specific embodiment thereof, it is to be understood that the invention can be practiced in other ways than that described above.

Figure 4:
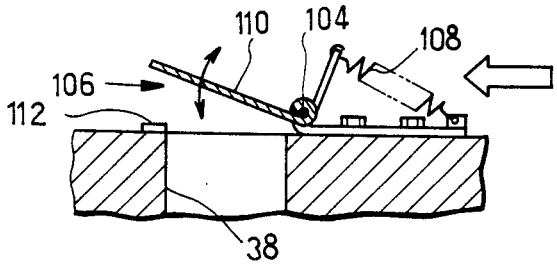
FIG. 4 is a schematic view of a flow control valve of the invention in another embodiment.

For example, in place of the slider 90 which is so disposed in the above-illustrated embodiment that it can slide on the periphery of the front side plate 4 in the peripheral direction thereof, a flow control plate 106 may be provided which is swingable on a support shaft 104, as shown in FIG. 4. The control plate 106 includes a flap or lid portion 110, which is movable towards and away from the opening of the suction passage 38 and a spring 108 as a resilient member which biases the lid portion 110 away from the opening 38. The lid portion 110 may double as a pressure-receiving portion which is subjected to the influence of the dynamic pressure of the refrigerant gas flowing in the direction shown by the arrow. In such an arrangement, it is desirable that a stop member 112 should be provided, projecting slightly from the edge portion of the opening, so that the lid portion 110 of the plate 106 may not be placed under the influence of a suction force created in the suction passage 38.

Figure 5:
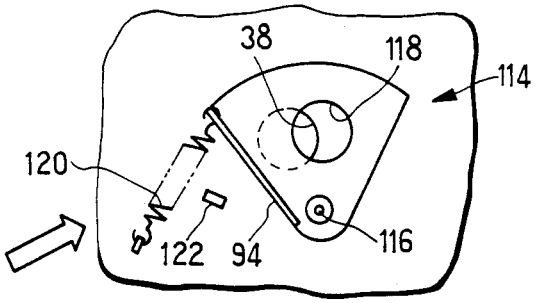
FIG. 5 is also a schematic view of another flow control valve in accordance with the invention.
Figure 8:
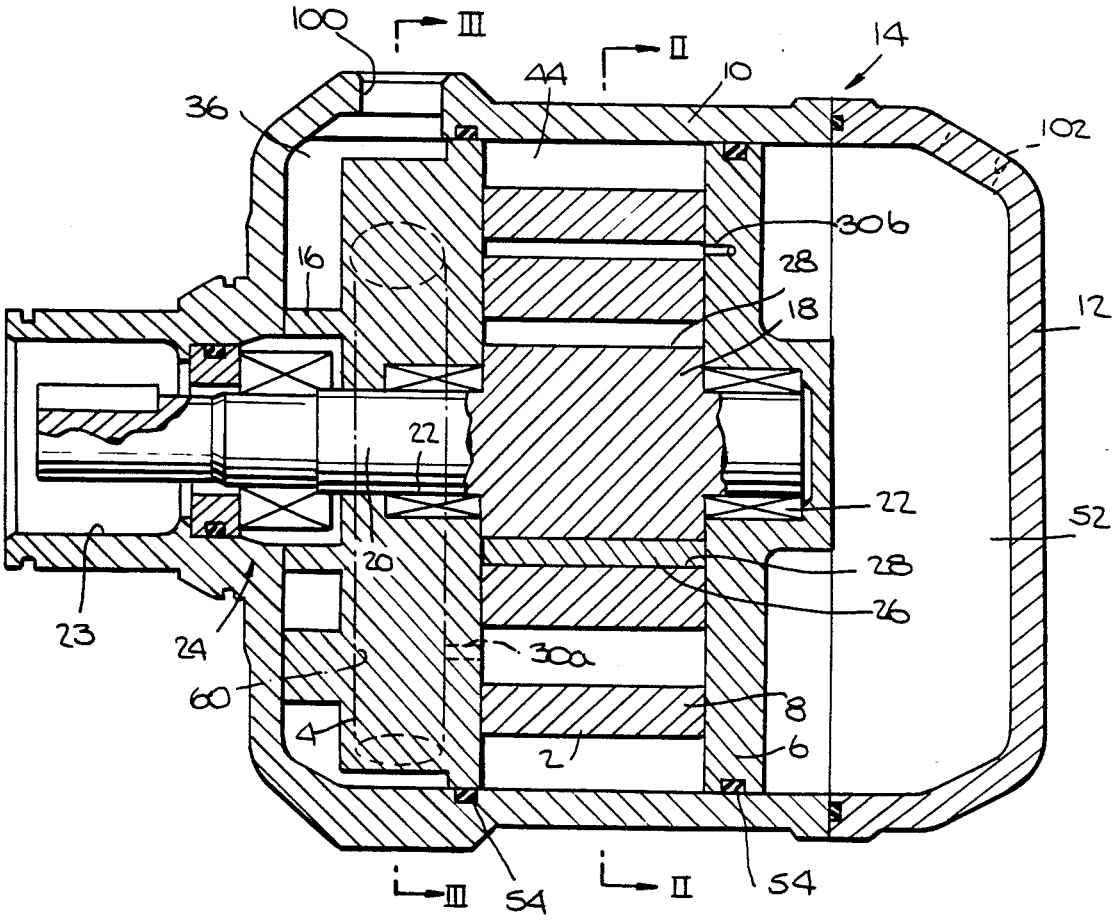

Alternatively, a flow control plate 114 in the form of a segment may be employed, as represented in FIG. 5, which is supported at its base end by a rotatable support shaft 116 and movable in parallel relation to the plane of the opening of the suction passage 38. The plate 114 is formed with an aperture 118 and includes a spring 120 which acts to urge the plate 114 towards a position where said aperture 118 is substantially aligned with the opening of the suction passage 38. The plate 114 further has a pressure-receiving portion 94 provided so as to receive the influence of the dynamic pressure of the gas due to its flow (indicated by an arrow in FIG. 5) acting in a direction to reduce the effective open area of the opening 38 by moving the plate 114 against the biasing pressure exerted by the spring 120. In the arrangement of FIG. 5 wherein no biasing means is provided to counteract the spring 120, it is desirable that a stop member 122 should be positioned for limiting the movement of the plate 114 in the direction to widen the open area of the opening.

Although in the above preferred and modified embodiments of the present invention the suction passage 38 is opened to the peripheral surface of the front side plate 4, it may be opened to the front face of the front side plate 4 and, accordingly, the flow control means, such as the slider 90 or the plate 106 or 114, may be disposed adjacent to the opening of such a passage. Furthermore, the flow control means may be disposed other than in a position adjacent to the opening of the suction passage 38 communicating with the main inlet port 32. For example, a position adjacent to an opening of any suction passage on the side of the suction chamber 36, such as the suction chamber 40 in communication with the auxiliary suction port 34, may be selected.

It should be noted that the gas flow control means may be dispensed with. In such a case, when the compressor speed is increased rapidly, the spool 64 is caused to move from its partial-load to full-load position thereby increasing the load on the engine temporarily, although the effect intended by the invention, to shift the compressor between its full-load and partial-load positions depending upon the varying cooling load, can be accomplished successfully over a fairly wide range of speeds.

Figure 7:
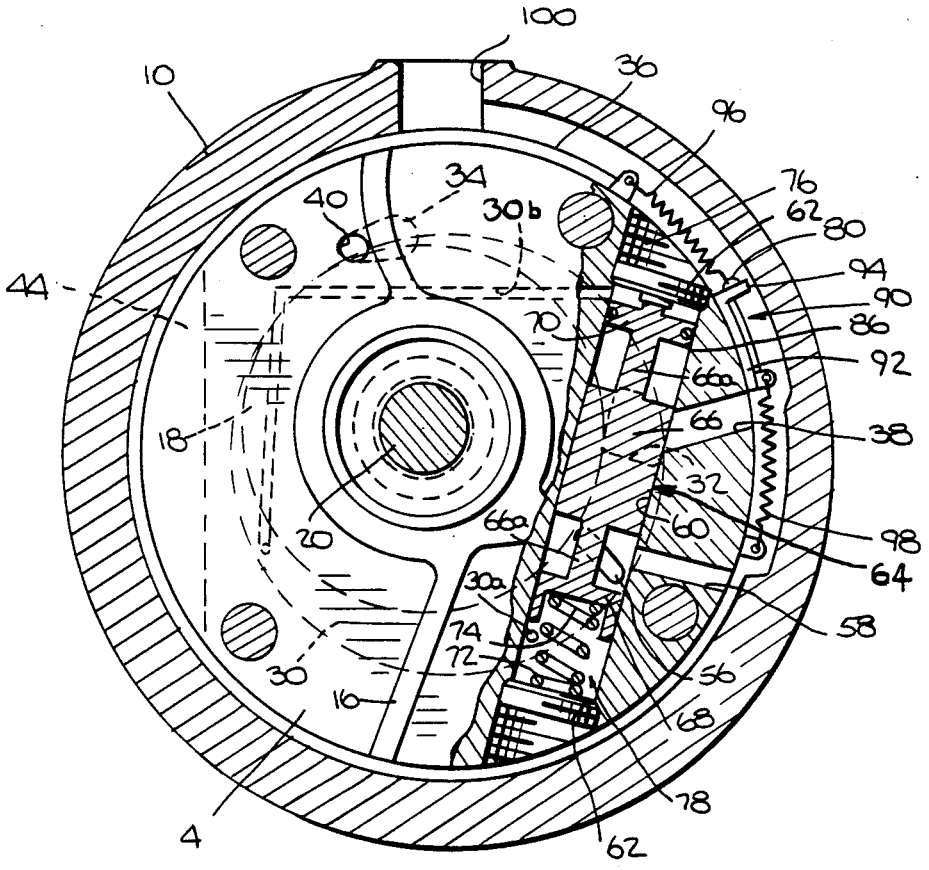

As to the valve spool 64, instead of the preferred embodiment according to which the gas pressure in the suction chamber 36 acts on the first pressure-receiving face 74 of the spool while the pressure in the discharge chamber 44 acts on the second pressure-receiving face 76 thereof, it may be arranged such that the gas pressure in the compression chamber 30 which is before or in an early stage of compression is admitted through any suitable communicating passage so as to act on the first face 74, such as by providing a gas passage **30*a* between one of the compression chambers 30 and the low-pressure cavity 78 as illustrated in FIGS. 6 and 7. The gas pressure in the compression chamber in the middle of the compression process is allowed via any convenient passage to act on the second face 76, as by providing a gas passage 30*b* extending between the high-pressure cavity 80 and one of the compression chambers 30 whose volume is being decreased, as shown in FIGS. 6 and 7. Because the valve spool 64 tends to be shifted to its full-load position temporarily upon a rapid build-up of compressor speed in such an arrangement, it is desirable to provide flow control means such as the slider 90 or the control plate 106 or 114** for preventing such a situation from taking place.

Regarding the spring 72 which urges the valve spool 64 towards its full-load position, it may be so provided that its biasing force may be changed very little by a certain amount of deflection or compression thereof. This can be accomplished by preloading the spring sufficiently. Using such provision of the spring 72, the spool 64 will be shifted to its partial-load position immediately when a predetermined value for the difference of gas pressures acting on the first and second pressure-receiving faces 74, 76 of the spool is reached.

While the invention has been described and illustrated specifically with reference to various embodiments in a rotary compressor of the vane type as utilized in an automotive cooling system, it is to be understood that the invention can be applied to rotary compressors of various types including screw-type, scroll-type, etc. without departing from the spirit or scope thereof. Of course, the invention is not limited to compressors designed for cooling of the driver's compartment in a vehicle, but it applicable to any compressor to be used for similar or different purposes.

What is claimed is:

1. A rotary compressor for compressing a refrigerant gas, comprising:

a housing;

a drive shaft rotatably supported in said housing and having a rotor thereon which is rotatable with said drive shaft;

means defining a plurality of compression chambers whose respective volumes sequentially and progressively increase from substantially zero to a maximum volume and thereafter decrease from said maximum volume to substantially zero responsive to rotation of said rotor;

means defining a suction chamber within said housing for containing refrigerant gas to be introduced into said compression chambers;

means defining a suction passage within said housing extending between said suction chamber and at least one of said compression chambers whose volume is being increased;

means defining a discharge chamber within said housing for receiving compressed refrigerant gas from at least one of said compression chambers whose volume is being decreased;

means defining a by-pass passage within said housing extending between said suction chamber and one of said compression chambers whose volume is being decreased;

control valve means within said housing including a valve member movable between a first position thereof opening said suction passage and closing said by-pass passage and a second position thereof at least partially closing said suction passage and opening said by-pass passage, and means biasing said valve member towards its said second position;

means for exposing said valve member to compressed refrigerant gas pressure urging said valve member towards its said first position;

and means for exposing said valve member to suction chamber refrigerant gas pressure urging said valve member towards its said second position.

2. A rotary compressor according to claim 1, wherein said control valve means further comprises means of said housing defining a valve member chamber, said valve member being mounted for said movement therein, and wherein said means biasing said valve member towards its said second position comprises a spring mounted in said valve member chamber and engaging said valve member.

3. A rotary compressor according to claim 1, wherein said control valve means further comprises means of said housing defining a valve member chamber, said valve member being mounted for said movement therein, said means for exposing said valve member to compressed refrigerant gas pressure comprising a high-pressure cavity of said valve member chamber, and said means for exposing said valve member to suction chamber refrigerant gas pressure comprising a low-pressure cavity of said valve member chamber.

4. A rotary compressor according to claim 3, wherein said means for exposing said valve member to suction chamber refrigerant gas pressure further comprises gas passage means extending between said low-pressure cavity and one of said compression chambers whose volume is being increased.

5. A rotary compressor according to claim 3, wherein said means for exposing said valve member to suction chamber refrigerant gas pressure further comprises gas passage means extending between said low-pressure cavity and said suction chamber.

6. A rotary compressor according to claim 3, wherein said means for exposing said valve member to compressed refrigerant gas pressure further comprises gas passage means extending between said high-pressure cavity and one of said compression chambers whose volume is being decreased.

7. A rotary compressor according to claim 3, wherein said means for exposing said valve member to compressed refrigerant gas pressure further comprises gas passage means extending between said high-pressure cavity and said discharge chamber.

8. A rotary compressor according to claim 1, wherein said housing comprises a cylinder block providing a cylindrical bore, said rotor being mounted within, and eccentrically with respect to said cylindrical bore.

9. A rotary compressor according to claim 8, wherein said housing further comprises a side plate secured to an end of said cylinder block and defining said suction chamber, said side plate having said suction passage and said by-pass passage formed therein.

10. A rotary compressor according to claim 9, wherein said side plate further has means defining a valve member chamber therein, said valve member being mounted within said valve member chamber.

11. A rotary compressor according to claim 1, which further comprises flow control means mounted on said housing adjacent to said suction passage for regulating the flow of said refrigerant gas from said suction chamber to said suction passage, said flow control means comprising a movable valve portion for opening and closing said suction passage, and a pressure portion on said movable valve portion disposed for impingement by said flow of said refrigerant gas to said suction passage to move said movable valve portion in direction tending to close said suction passage, and means biasing said movable valve portion in direction tending to open said suction passage.

12. A rotary compressor according to claim 11, wherein said housing comprises a cylinder block providing a cylindrical bore, said rotor being mounted within, and eccentrically with respect to said cylindrical bore, and side plate means having a exterior peripheral portion within said suction chamber, said suction passage having an end opening through said plate means peripheral portion to receive said refrigerant gas from said suction chamber, said flow control means movable valve portion being mounted for movement on said plate means exterior peripheral portion for opening and closing said end of said suction passage, said flow control means further comprising spring means normally biasing said movable valve portion to an open position thereof with respect to said suction passage, and said pressure portion comprising a radially outward projecting portion on said movable valve portion.

13. A rotary compressor according to claim 12, wherein said movable valve portion is mounted for slidable movement on said plate means exterior peripheral portion, and said flow control means further comprises a second spring attached to said movable valve portion urging it towards its said second position.

14. A rotary compressor according to claim 12, wherein said flow control means movable valve portion comprises a swingable plate mounted on said plate means exterior peripheral portion for pivotable movement between respective closed and normally opened positions with respect to said suction passage opening, stop means on said plate means exterior peripheral portion for engagement by said movable valve portion to determine its said open position, and aperture means through said movable valve portion corresponding to said suction passage open end and providing an opening through said movable valve portion when in its said open position.

15. A rotary compressor according to claim 12, wherein said flow control means movable valve portion is mounted for pivotable movement towards and away from said plate means exterior peripheral portion between a closed position thereof substantially closing said suction passage opening and said normally open position thereof, and a projecting stop member on said plate means exterior peripheral portion adjacent to said suction passage opening for engagement by said movable valve portion to prevent full closing of said suction passage opening when said movable valve portion is in its said closed position.

16. A rotary compressor according to claim 1, wherein said control valve means further includes means for developing frictional force resisting initial movement of said valve member towards either of its said positions.

17. A rotary compressor according to claim 16, wherein said means for developing frictional force comprises an O-ring around said valve member.

18. A rotary compressor according to claim 1, which further comprises means defining an auxiliary suction passage communicating at one end thereof with said suction chamber, and at the other end thereof with one of said compression chambers whose volume is being increased.

19. A rotary compressor according to claim 10, wherein said means for exposing said valve member to compressed refrigerant gas pressure comprises a high-pressure cavity of said valve member chamber and gas passage means extending between said high-pressure cavity and said discharge chamber, and said means for exposing said valve member to suction chamber refrigerant gas pressure comprises a low-pressure cavity of said valve member chamber and gas passage means extending between said low-pressure cavity and said suction chamber, said side plate having a peripheral portion within said suction chamber and means defining at least a portion including an end opening of said suction passage in said plate peripheral portion, and flow control means mounted for movement on said plate peripheral portion for regulating the flow of said refrigerant gas from said suction chamber to said suction passage, said side plate further having means defining an auxiliary suction passage communicating at one end thereof with said suction chamber and at the other end thereof with one of said compression chambers whose volume is being increased.

* * * * *